US008875615B1

(12) United States Patent
Westendorf

(10) Patent No.: US 8,875,615 B1
(45) Date of Patent: Nov. 4, 2014

(54) TWO PISTON CYLINDER

(71) Applicant: Westendorf Manufacturing Co., Inc., Onawa, IA (US)

(72) Inventor: Neal W. Westendorf, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 14/072,880

(22) Filed: Nov. 6, 2013

Related U.S. Application Data

(63) Continuation of application No. 13/567,596, filed on Aug. 6, 2012, now Pat. No. 8,601,934.

(51) Int. Cl.
*F15B 15/16* (2006.01)
*F15B 21/04* (2006.01)

(52) U.S. Cl.
CPC ..... *F15B 21/04* (2013.01)
USPC ..... 92/112; 92/52; 92/108

(58) Field of Classification Search
USPC ..... 92/52, 107, 108, 110, 112
See application file for complete search history.

(56) References Cited

U.S. PATENT DOCUMENTS

| | | | | | |
|---|---|---|---|---|---|
| 1,788,298 | A | * | 1/1931 | Hottel | 92/110 |
| 2,511,883 | A | * | 6/1950 | Thierry | 91/399 |
| 3,335,642 | A | * | 8/1967 | Rosaen | 92/110 |
| 3,563,136 | A | * | 2/1971 | Valente | 91/519 |
| 3,592,108 | A | * | 7/1971 | Rosaen et al. | 92/110 |
| 3,920,084 | A | * | 11/1975 | Russell, Jr. | 173/79 |
| 4,130,205 | A | * | 12/1978 | Luthi | 92/165 R |
| 4,531,451 | A | * | 7/1985 | Mouton | 92/108 |
| 4,750,408 | A | * | 6/1988 | Stoll | 92/51 |
| 4,791,854 | A | * | 12/1988 | Banicevic | 92/5 R |
| 5,186,095 | A | * | 2/1993 | Todd | 91/518 |
| 5,957,029 | A | * | 9/1999 | Boyer et al. | 92/5 R |
| 6,116,140 | A | * | 9/2000 | Barthalow et al. | 91/167 R |

* cited by examiner

*Primary Examiner* — Thomas E Lazo
(74) *Attorney, Agent, or Firm* — Joseph M. Butscher; The Small Patent Law Group LLC

(57) ABSTRACT

A two piston cylinder providing asymmetrical expansion and retraction capabilities is disclosed having two linked expansion chambers and a single chamber for retraction. The retraction chamber is situated between the two expansion chambers, and the expansion chambers are linked together by a tube passing through the piston that provides hydraulic fluid to both the retraction chamber and one of the expansion chambers.

20 Claims, 5 Drawing Sheets

TWO PISTON CYLINDER

CROSS-REFERENCE TO RELATED APPLICATIONS

The present application is a continuation of U.S. patent application Ser. No. 13/567,596, entitled "Two Piston Cylinder," filed Aug. 6, 2012, now U.S. Pat. No. 8,601,934, which is hereby expressly incorporated by reference in its entirety.

FIELD OF THE INVENTION

The present invention relates generally to hydraulic cylinders, and more specifically to dual acting hydraulic cylinders that provide an asymmetrical power output during extension and retraction of a ram.

BACKGROUND OF THE INVENTION

Hydraulic cylinders typically consist of a cylinder barrel, in which a piston connected to a piston rod moves back and forth. The barrel is closed on each end by an end cap and by a gland where the piston rod comes out of the cylinder. The piston has sliding rings and seals. Typically, the piston divides the inside of the cylinder in two chambers, the expansion chamber and the retraction chamber.

In a single acting cylinder, hydraulic fluid is supplied to the expansion chamber, which applies a force against a first side of the piston causing it to move thereby increasing the size of the expansion chamber. To retract the cylinder, an external force is applied against the piston rod that causes the hydraulic fluid to exit from the expansion chamber.

In a dual acting cylinder, hydraulic fluid is supplied to the expansion chamber to extend the piston as with the single acting cylinder. For retraction, hydraulic fluid is supplied to the retraction chamber which applies a force against a second side of the piston causing it to retract. In a dual acting cylinder, the force supplied by the hydraulic fluid is dependent on the pressure of the hydraulic fluid and the surface area of the piston in contract with the hydraulic fluid. As a result of the two sides of the piston having similar surface areas and a common source typically being used to supply fluid for retraction and expansion, the ability of the cylinder to expand and contract against a load is often quite similar.

While the expansion and retraction abilities of a dual acting cylinder are often quite similar, it is common for substantially more power to be needed in the expansion direction as compared to retraction. When hydraulic cylinders are used on front end loaders, forces from gravity often assist in the retraction of the cylinder.

Attempts have been made by others to create hydraulic cylinders with asymmetric expansion and retraction power, however these designs typically involve a cumbersome additions to the cylinder and require a substantial increase in cylinder size.

U.S. Pat. No. 1,788,298 issued to Hottel in 1928 describes a fluid press or jack with an expansible chamber . . . a second expansible chamber between the inner face of the piston head and the ring or abutment . . . . For the purpose of simultaneously admitting fluid-pressure into the expansible chamber and the expansible chamber, a connection communicates with the chamber and a passageway is formed in the wall of the combined piston and cylinder structure. The Hottel design requires an extremely thick cylinder wall and is not practical for situations where the weight of the cylinder is a consideration.

U.S. Pat. No. 3,563,136 issued to Valente in 1971 describes a variable force hydraulic press with conduit means provided in said housing to achieve a fluid path from each said chamber to the exterior thereof, said fluid paths being associated with a source of fluid under pressure and control means. Accordingly, a selective application of fluid pressure to either or both said chambers may be attained, with the force exerted by said ram varying according to the total piston surface area subject to said fluid pressure. Like the Hottel patent, the Valente patent describes a press that requires a substantial amount of material and is not practical for situations where the weight of the hydraulic cylinder is a consideration.

SUMMARY OF THE INVENTION

A two piston cylinder providing asymmetrical expansion and retraction capabilities is disclosed having two linked expansion chambers and a single chamber for retraction. The retraction chamber is situated between the two expansion chambers, and the expansion chambers are linked together by a tube passing through the piston that provides hydraulic fluid to both the retraction chamber and one of the expansion chambers.

DETAILED DESCRIPTION

The present invention may be used with any fluid operable device. Although the preferred embodiment of the present invention is intended and adapted for use as a hydraulic cylinder on a loader and tractor, those of skill in the art will recognize that the present invention is equally adaptable for use with other fluid operable devices. However, for descriptive purposes, the present invention will be described in use of a hydraulic cylinder.

Figure 1:
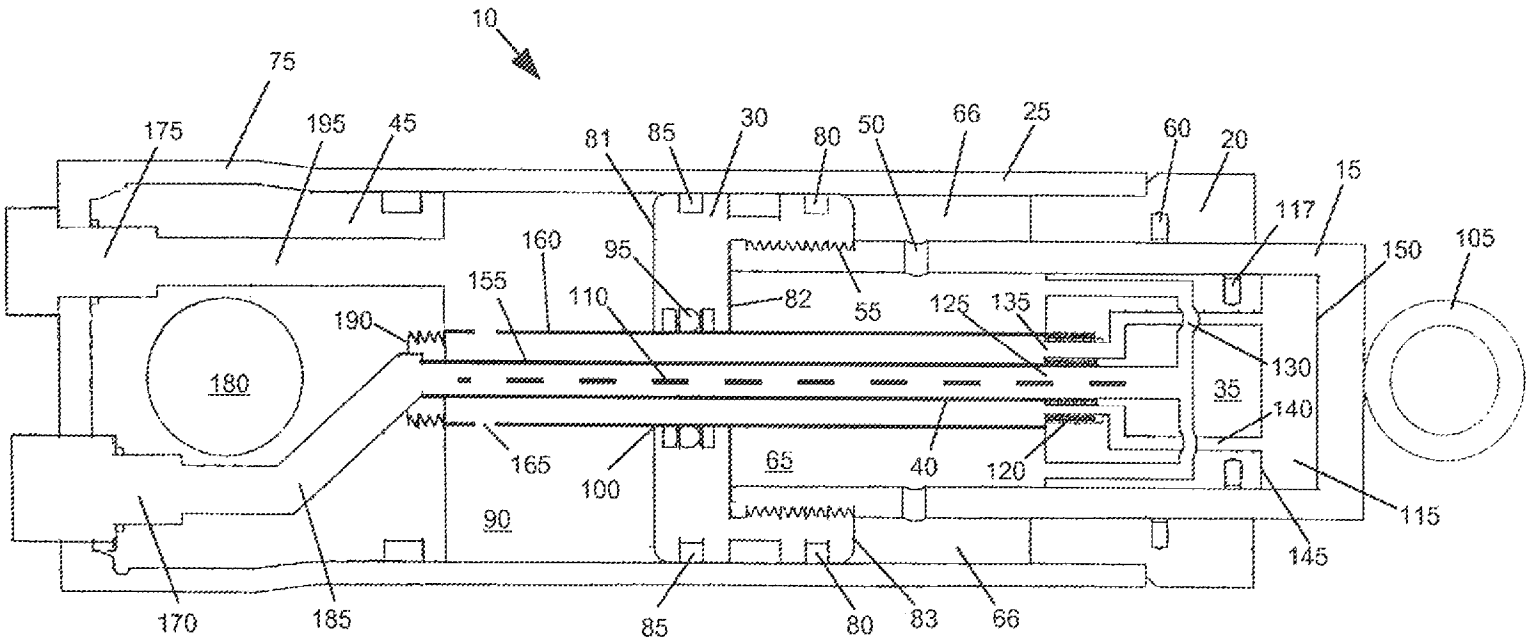
FIG. 1 shows a cross section of a two piston hydraulic cylinder.

FIG. 1 illustrates an example of a two piston cylinder 10 having a hollow ram 15 passing through an outer gland 20 that is welded onto a barrel 25. The ram 15 is threaded onto a piston 30 and encloses an inner gland 35 that is threaded onto a double walled concentric tube 40. The concentric tube 40 passes through the piston 30 and is threaded into an oil inlet gland 45. The ram 15 is substantially hollow to enclose the inner gland 35 and is of sufficient strength to withstand the pressure of hydraulic fluid radially pressing against the interior of the ram. In the wall of the ram 15, a plurality of ram holes 50 are located between the concentric tube 40 and the barrel 25. The ram holes 50 allow hydraulic fluid to pass from within the ram 15 to the gap between the ram 15 and the barrel 25. A plurality of ram threads 55 are used to secure the ram 15 to the piston. Aside from the ram threads 55, the piston is symmetrical about an axis of rotation 110.

The outer gland 20 includes an outer o-ring 60 pressed against the ram 15. The outer o-ring 60 prevents hydraulic fluid from exiting the retraction chamber 65 as the ram 15 retracts back into the barrel 25.

The barrel 25 includes an expanded end 75 that accepts the oil inlet gland 45, but does not allow the gland to pass further into the barrel. U.S. Pat. No. 7,455,010 issued to Westendorf and Langenfeld, herein incorporated by reference, describes the expanded barrel in more detail.

The piston 30 includes a first and second outer seal (80 and 85) between the piston 30 and the barrel 25 that acts to prevent hydraulic fluid from passing from the retraction chamber 65 to the inner expansion chamber 90. The piston 30 also includes an inner seal 95 around a hole 100 through which the concentric tube 40 passes. As with the first and second outer seals (80 and 85), the inner seal 95 acts to prevent the flow of hydraulic fluid from the retraction chamber 65 to the main expansion chamber 90. In the illustrated example, the hole 100 is a circular hole centrally located on the axis of the piston 30 while the concentric tube 40 is circular. The concentric nature of the hole and piston allows the ram 15 to rotate about the concentric tube 40 which allows the ram pin 105 to rotate if needed. For situations where rotation of the ram pin 105 is unwanted, the inventor contemplates using a piston 30 that has a hole 100 that is not aligned with the axis of rotation 110 of the two piston cylinder. Other designs, such as a rectangular concentric tube, may be used to limit the rotation of the ram 15.

The piston 30 has an expansion face 81 upon which hydraulic fluid acts to move the piston and expel the ram 15 from the cylinder. The piston also has a first retraction face 82 and a second retraction face 83. The first retraction face 82 is located within the ram 15 while the second retraction face 83 is located between the ram 15 and the barrel 20. The ram holes 50 in the barrel allow hydraulic fluid to flow from the retraction chamber 65 to the outer retraction chamber 66 or auxiliary chamber and act upon the second retraction face 83 of the piston. While the ram holes 50 increase the retraction power of the cylinder 10 by allowing the hydraulic fluid to act upon the second retraction face 83 of the piston 30, the inventor contemplates that the ram 15 may be constructed without ram holes 50. Removing the ram holes 50, would prevent hydraulic fluid from entering the second retraction chamber 66 which would decrease the retraction power of the cylinder, but would allow the cylinder to retract more quickly with a comparable flow rate of hydraulic fluid.

The inner gland 35 is enclosed by the ram 15 and substantially encircled by the outer gland 20. Within the ram 15, the inner gland 35 acts to separate the retraction chamber 65 from the outer expansion chamber 115. An inner gland seal 117 presses against the ram 15 to prevent hydraulic fluid in the outer expansion chamber 115 from leaking into the retraction chamber 65. In the illustrated example, the inner gland 35 is threaded onto the concentric tube 40 with inner gland threads 120. The inner gland 35 is secured to the concentric tube 40 in such a way to receive hydraulic fluid from the tube for both expansion and retraction of the ram 15. In the illustrated example, the inner gland 35 includes a retraction port 125 on the axis of rotation 110 that is adapted to receive hydraulic fluid for retraction of the ram 15. From the retraction port 125 the fluid passes through a retraction path 130 and into the retraction chamber 65. An expansion port 135 on the inner gland 35 receives hydraulic fluid from the concentric tube and passes it through an expansion path 140 to the outer expansion chamber 115. In the illustrated example, the expansion port 135 is concentric around the axis of rotation 110, however non-concentric designs are also contemplated. Two retraction and expansion paths 130 and 140 are shown, however more or less paths may be used. Additionally, the inner gland 35 may lack any retraction paths due to the concentric tube directly providing hydraulic fluid to the retraction chamber as seen in other figures. The inner gland 35 has a flat outer face 145 that matches the flat face 150 of the ram 15. With matching faces, the minimum size of the outer expansion chamber 115 is reduced and the range of movement of the ram 15 through the cylinder may be increased. Although a small minimal size of the outer expansion chamber 115 is preferred, The flat face 150 of the ram 15 should not block the expansion paths 140 of the inner gland 35 when the ram 15 is fully retracted since the force exerted by the hydraulic fluid on the ram is related to the surface area of the flat face 150 upon which the hydraulic fluid presses.

The concentric tube 40 includes an inner tube 155 and an outer tube 160. In the illustrated example, both the inner and outer tubes (155 and 160) are concentric around the axis of rotation 110. The inner tube 155 is secured to, and receives hydraulic fluid directly from, the oil inlet gland 45. The inner tube is also secured to the retraction port 125 in the inner gland 35, and serves to transfer hydraulic fluid from the oil inlet gland 45 to the inner gland 35. While the inventor contemplates a variation in which the outer tube 160 receives hydraulic fluid directly from the oil inlet gland 45, in the illustrated example the outer tube includes tube holes 165 located adjacent to the oil inlet gland 45 that fluidly connects the inner expansion chamber 90 and the outer expansion chamber 115 by allowing hydraulic fluid to flow from the inner expansion chamber 90 into the outer tube 160. The outer tube 160 serves to transfer the hydraulic fluid from the tube holes 165 to the expansion port 135 of the inner gland 35. The inner and outer tubes (155 and 160) of the concentric tube 40 are preferably of robust construction as the concentric tube serves to transfer all of the expansion forces on the flat outer face 145 of the inner gland to the oil inlet gland 45. Additionally, during retraction of the ram 15 the combination of the concentric tube 40 and the outer gland 20 experience a force equal to those experienced by the ram pin 105.

The oil inlet gland 45 is secured in the expanded end 75 of the barrel 15 and includes a retraction fluid port 170, an expansion fluid port 175, and a gland pin 180. In the illustrated example, a retraction fluid path 185 leads to a threaded region 190 on the oil inlet gland 45 that is secured to the concentric tube 40. The retraction fluid path 185 feeds oil directly to the inner tube 155 from the retraction fluid port. An expansion fluid path 195 extends through the oil inlet gland 45 between the expansion fluid port 175 and the inner expansion chamber 90. The retraction fluid port 170 and the expansion fluid port 175 are in close proximity on the oil inlet gland 45 which allows the expansion fluid line (not shown) and the retraction fluid line (not shown) to be run to approximately the same place. Standard dual acting cylinders require fluid lines to be run to opposite ends of the hydraulic cylinder which creates a messy appearance and increases the likelihood that the lines will become snagged on something. The risk of catching fluid lines on foreign objects is especially great when the hydraulic cylinders are used on agricultural machinery such as a front end loader.

Figure 2:
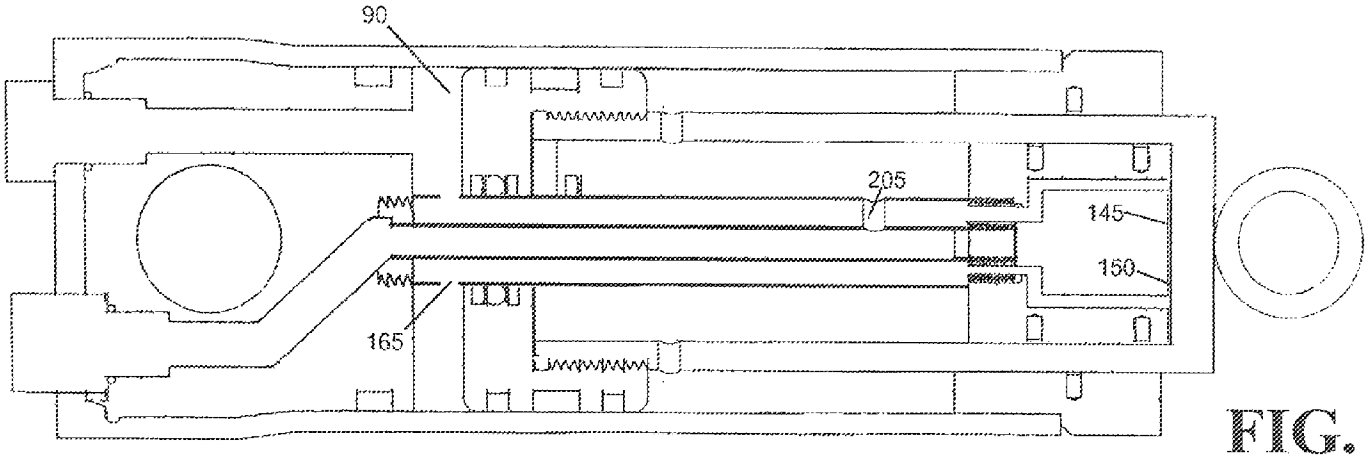
FIG. 2 shows a cross section of a two piston hydraulic cylinder fully retracted.
Figure 3:
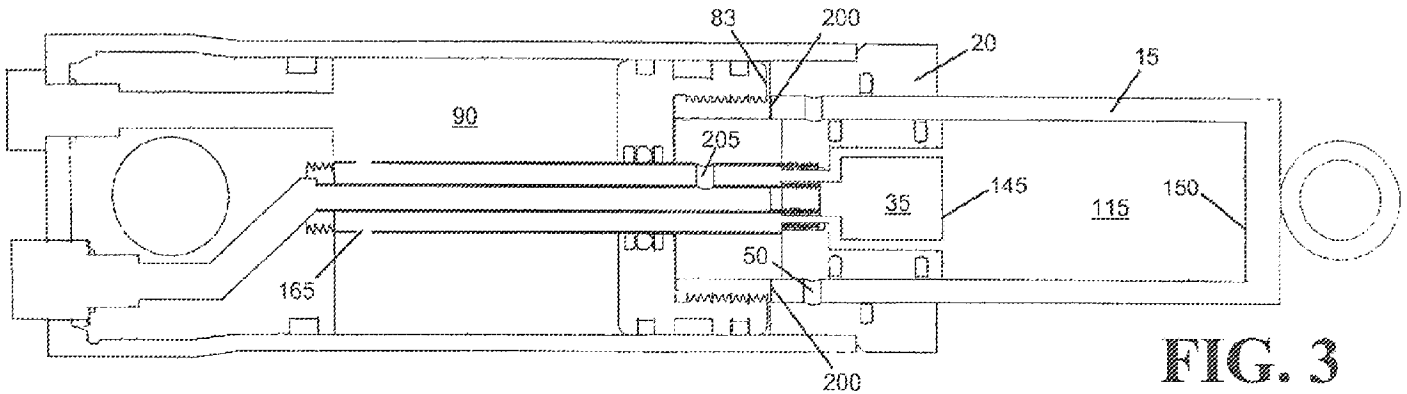
FIG. 3 shows a cross section of a two piston hydraulic cylinder fully extended.

FIG. 2 illustrates an example of a cylinder fully retracted while FIG. 3 illustrates an example of a cylinder that has been fully extended. In FIG. 2, the flat outer face 145 of the inner gland 45 is in close proximity with the flat face 150 of the ram 15. Further retraction of the cylinder is prevented by the contact of the two flat faces. The tube holes 165 are near the piston 30, however they are still accessible so that the hydraulic fluid in the inner expansion chamber 90 may flow to the outer expansion chamber 115 (extremely small in FIG. 2). In FIG. 3, the second retraction face 83 of the piston 30 is pressed against the outer gland 20 preventing further expansion of the cylinder. Alternatively, a small portion of hydraulic fluid may become trapped between the second retraction face 83 and the outer gland 20 after the ram holes 50 are fully blocked by the outer gland 20 and the inner gland 35. The trapped fluid prevents the ram 15 from expanding. In the illustrated example, bore holes 200 pass through the ram adjacent to the second retraction face 83. After the ram holes 50 are blocked, the bore holes 200 in the ram 15 allow the hydraulic fluid to slowly flow back into the retraction chamber 65. The slowed movement of the hydraulic fluid acts as a shock absorber and prevents the piston 30 from forcefully striking the outer gland 20 during rapid expansion of the cylinder. FIGS. 2 and 3 also illustrate alternate forms of the concentric tube 40 and inner gland 35. In the illustrated example, an inner tube path 205 extends directly from the inner tube 155 to the retraction chamber 65. Also, the inner gland 35 does not contain any retraction paths 130 because the hydraulic fluid for retraction is provided directly from the concentric tube 40.

Figure 4:
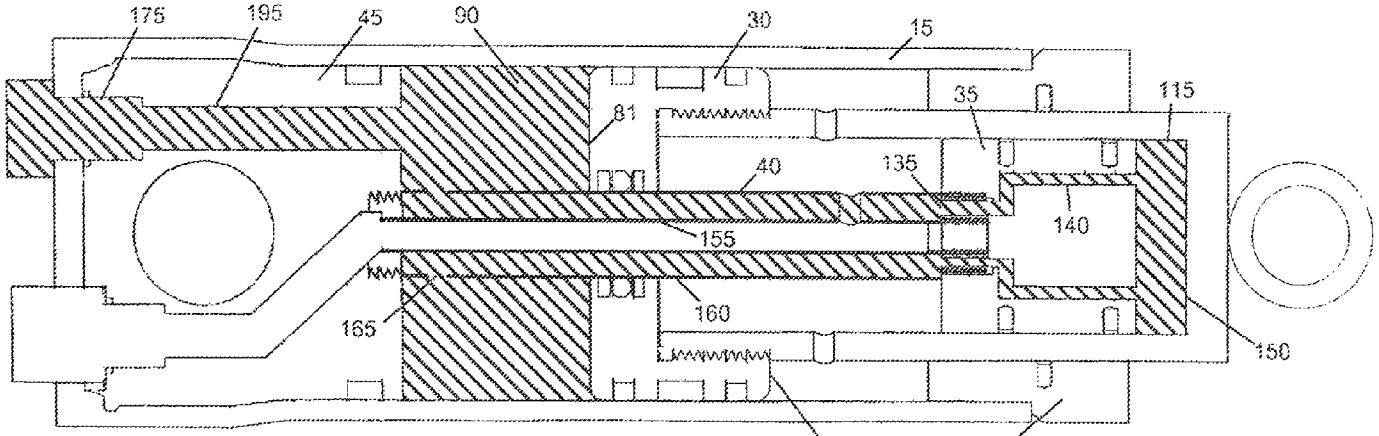
FIG. 4 shows a cross section of a two piston hydraulic cylinder with hydraulic fluid flowing in to extend the ram.

FIG. 4 illustrates the flow of hydraulic fluid into the cylinder to extend the ram. An expansion fluid line (not shown) supplies hydraulic fluid to the expansion fluid port 175 which then flows through the expansion fluid path 195 of the oil inlet gland 45 to the inner expansion chamber 90. A portion of the hydraulic fluid in the inner expansion chamber acts upon the expansion face 81 of the piston 30 to move the ram 15 outward, while another portion of the hydraulic fluid passes through the tube holes 165 and enters the gap between the inner tube 155 and the outer tube 160. The hydraulic fluid flows through the concentric tube 40 until it enters the inner gland 35 at the expansion port 135. From the expansion port 135, the hydraulic fluid moves through the expansion path 140 in the inner gland 35 until it reaches the outer expansion chamber 115 where it acts upon the face 150 of the ram 15 to assist in extension of the ram 15. The hydraulic fluid is capable of extending the ram 15 until the second retraction face 83 of the piston 30 contacts the outer gland 20. The combined volumes of the inner expansion chamber 90, the retraction chamber 65, and the outer expansion chamber 115 increases as the piston 30 moves away from the oil inlet gland 45.

Figure 5:
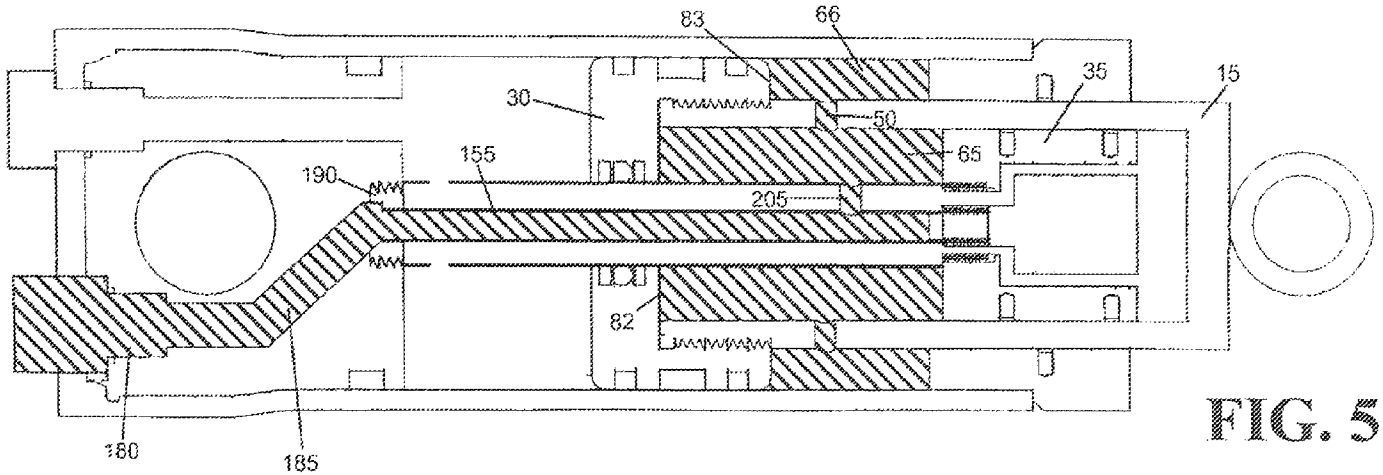
FIG. 5 shows a cross section of a two piston hydraulic cylinder with hydraulic fluid flowing in to retract the ram.
Figure 6:
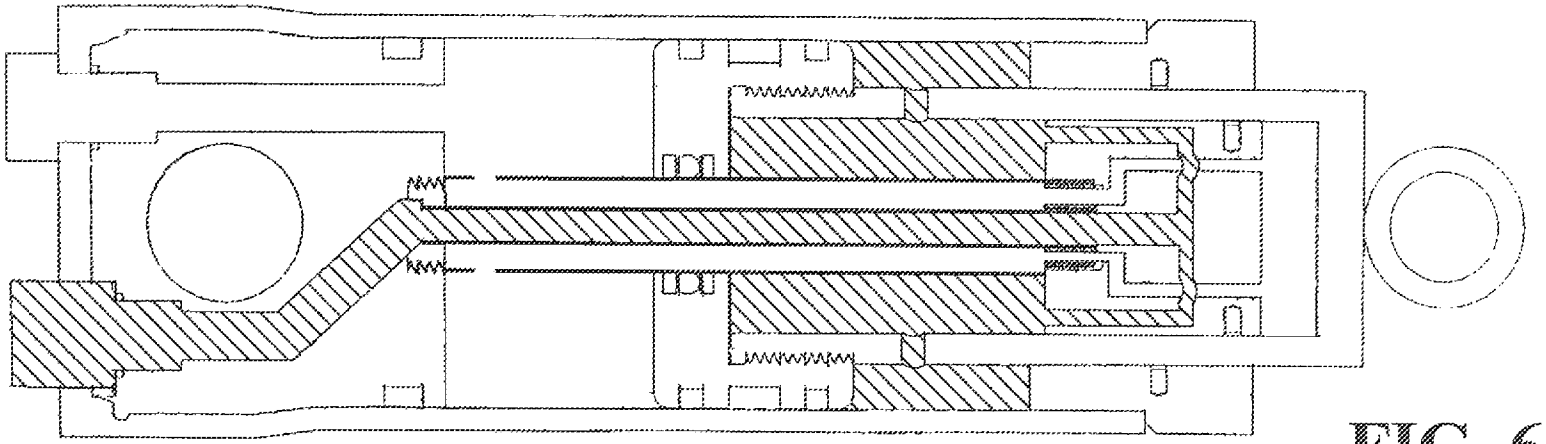
FIG. 6 shows a cross section of a two piston hydraulic cylinder with hydraulic fluid flowing in to retract the ram.
Figure 7:
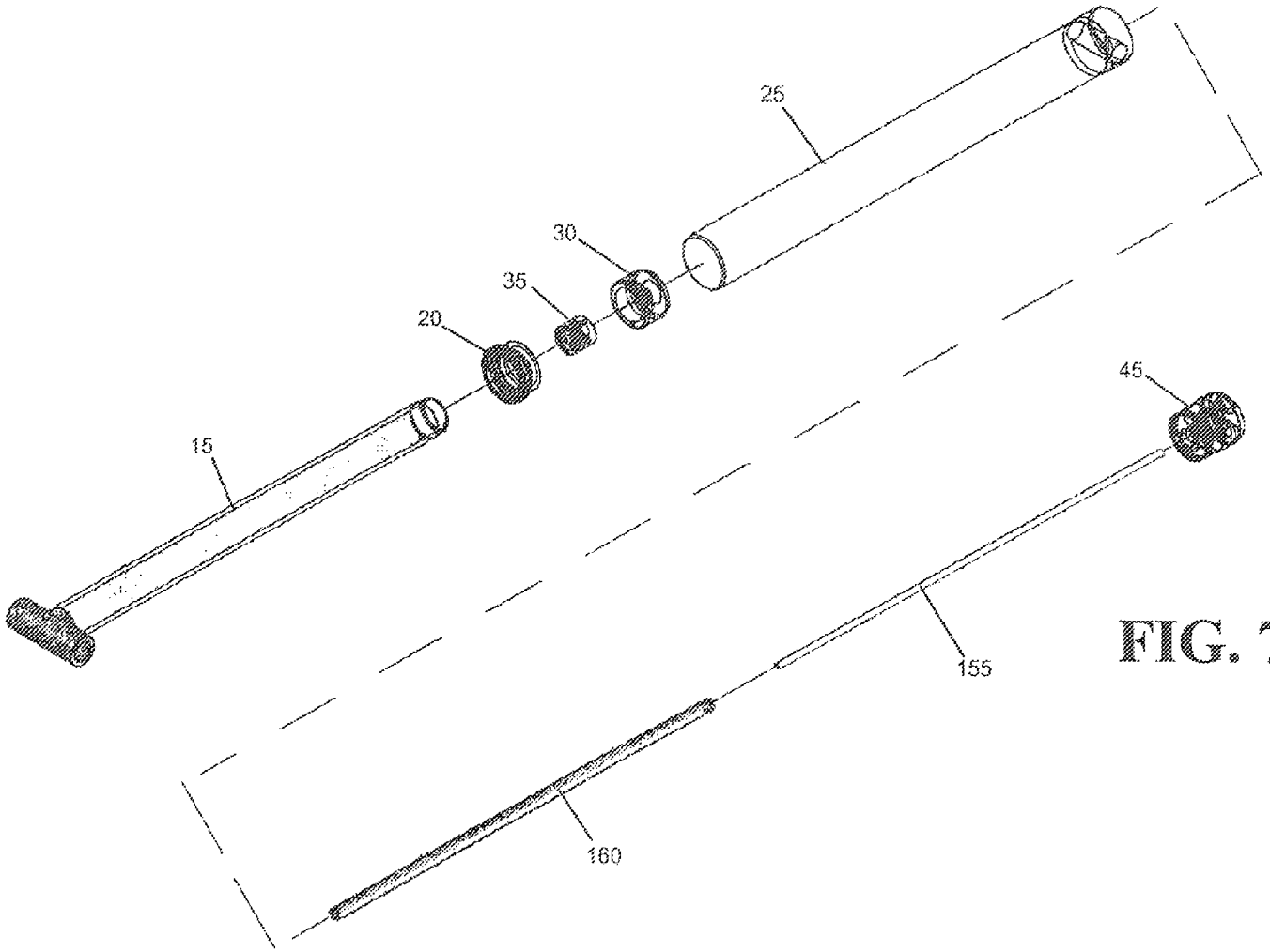
FIG. 7 shows an exploded perspective view of a two piston hydraulic cylinder.

FIG. 5 illustrates the flow of hydraulic fluid into the hydraulic cylinder to retract the ram 15. A retraction fluid line (not shown) supplies hydraulic fluid to the retraction fluid port 180 which then flows through the retraction fluid path 185 of the oil inlet gland 45 until it reaches the threaded region 190 of the gland. At the threaded region 190, the hydraulic fluid enters the inner tube 155 of the concentric tube were it flows towards the inner gland 35. In the illustrated example, the hydraulic fluid passes through an inner tube path 205 to reach the retraction chamber 65 where it acts upon the first retraction face 82 of the piston 30 to retract the ram 15. A portion of the hydraulic fluid passes out of the retraction chamber 65 through the ram holes 50 in the ram 15 to reach the second retraction chamber 66 where it acts upon the second retraction face 83 of the piston to assist in the retraction of the ram. In another variation illustrated in FIG. 6, instead of passing through the inner tube path, the hydraulic fluid flows to a retraction port in the inner gland, where it then flows through a retraction path in the gland to reach the retraction chamber. FIG. 7 illustrates an exploded three dimensional view of a two piston hydraulic cylinder.

Other alterations, variations, and combinations are possible that fall within the scope of the present invention. Although the preferred embodiments of the present invention have been described, those skilled in the art will recognize other modifications that may be made that would nonetheless fall within the scope of the present invention. Therefore, the present invention should not be limited to the apparatus and method described. Instead, the scope of the present invention should be consistent with the invention claimed below.

The invention claimed is:

1. A hydraulic cylinder comprising:
- an outer barrel;
- a hollow ram secured to a piston, wherein the hollow ram is moveably secured within the outer barrel;
- a first retraction chamber disposed within a first end of the hollow ram;
- a first expansion chamber disposed within the hydraulic cylinder outside of the hollow ram;
- a second retraction chamber disposed between the hollow ram and the outer barrel;
- a second expansion chamber disposed within a second end of the hollow ram; and
- a retraction fluid port and an expansion fluid port, wherein both the retraction fluid port and the expansion fluid port are located at one end of the hydraulic cylinder.

2. The hydraulic cylinder of claim 1, further comprising a concentric tube that passes through the piston into the hollow ram.

3. The hydraulic cylinder of claim 2, wherein the concentric tube comprises:
- an inner tube secured to a fluid inlet gland and a retraction port of an inner gland within the hollow ram, wherein the inner tube is configured to transfer hydraulic fluid between the fluid inlet gland to the inner gland; and
- an outer tube fluidly connecting the first expansion chamber to the second expansion chamber, wherein the outer tube is configured to transfer the hydraulic fluid between the first and second expansion chamber.

4. The hydraulic cylinder of claim 2, further comprising an inner gland secured to a portion of the concentric tube, wherein the first retraction chamber is disposed between the inner gland and the piston, and wherein the second expansion chamber is disposed between the inner gland and an end face of the hollow ram.

5. The hydraulic cylinder of claim 4, wherein the inner gland comprises:
- a retraction port that is fluidly connected to one or both of the first and second retraction chambers; and
- an expansion port that is fluidly connected to one or both of the first and second expansion chambers.

6. The hydraulic cylinder of claim 1, wherein the hollow ram includes one or more ram holes configured to allow hydraulic fluid to pass from the first retraction chamber to the second retraction chamber.

7. The hydraulic cylinder of claim 1, wherein the hydraulic cylinder is devoid of any external fluid line outside of the outer barrel.

8. A hydraulic cylinder comprising:
- an outer barrel;
- a hollow ram secured to a piston, wherein the hollow ram is moveably secured within the outer barrel;
- an inner retraction chamber disposed within the hollow ram;
- an outer retraction chamber disposed between the hollow ram and the outer barrel;
- an inner expansion chamber disposed within the outer barrel outside of the hollow ram;
- an outer expansion chamber disposed within the hollow ram; and a retraction fluid port and an expansion fluid port, wherein both the retraction fluid port and the expansion fluid port are located at one end of the hydraulic cylinder.

9. The hydraulic cylinder of claim 8, further comprising a concentric tube that passes through the piston into the hollow ram.

10. The hydraulic cylinder of claim 9, wherein the concentric tube comprises:

an inner tube secured to a fluid inlet gland and a retraction port of an inner gland within the hollow ram, wherein the inner tube is configured to transfer hydraulic fluid between the fluid inlet gland to the inner gland; and an outer tube fluidly connecting the inner expansion chamber to the outer expansion chamber, wherein the outer tube is configured to transfer the hydraulic fluid between the inner and outer expansion chambers.

11. The hydraulic cylinder of claim 9, further comprising an inner gland secured to a portion of the concentric tube, wherein the inner retraction chamber is disposed between the inner gland and the piston, and wherein the inner expansion chamber is disposed between the inner gland and an end face of the hollow ram.

12. The hydraulic cylinder of claim 11, wherein the inner gland comprises:

a retraction port that is fluidly connected to one or both of the first and second retraction chambers; and an expansion port that is fluidly connected to one or both of the first and second expansion chambers.

13. The hydraulic cylinder of claim 8, wherein the hollow ram includes one or more ram holes configured to allow hydraulic fluid to pass from the inner retraction chamber to the outer retraction chamber.

14. The hydraulic cylinder of claim 8, wherein the hydraulic cylinder is devoid of any external fluid line outside of the outer barrel.

15. A hydraulic cylinder comprising:

an outer barrel;

a hollow ram secured to a piston, wherein the hollow ram is moveably secured within the outer barrel;

a concentric tube that passes through the piston into the hollow ram;

an inner retraction chamber disposed within the hollow ram;

an outer retraction chamber disposed between the hollow ram and the outer barrel;

an inner expansion chamber disposed within the outer barrel outside of the hollow ram;

an outer expansion chamber disposed within the hollow ram; and a retraction fluid port and an expansion fluid located at one end of the hydraulic cylinder, wherein the hydraulic cylinder is devoid of any external fluid line outside of the outer barrel.

16. The hydraulic cylinder of claim 15, wherein the concentric tube comprises:

an inner tube secured to a fluid inlet gland and a retraction port of an inner gland within the hollow ram, wherein the inner tube is configured to transfer hydraulic fluid between the fluid inlet gland to the inner gland; and an outer tube fluidly connecting the inner expansion chamber to the outer expansion chamber, wherein the outer tube is configured to transfer the hydraulic fluid between the inner and outer expansion chambers.

17. The hydraulic cylinder of claim 16, further comprising an inner gland secured to the inner tube, wherein the inner retraction chamber is disposed between the inner gland and the piston, and wherein the inner expansion chamber is disposed between the inner gland and an end face of the hollow ram.

18. The hydraulic cylinder of claim 17, wherein the inner gland comprises:

a retraction port that is fluidly connected to one or both of the first and second retraction chambers; and an expansion port that is fluidly connected to one or both of the first and second expansion chambers.

19. A hydraulic cylinder comprising:

an outer barrel;

a hollow ram secured to a piston, wherein the hollow ram is moveably secured within the outer barrel;

a first retraction chamber disposed within a first end of the hollow ram;

a first expansion chamber disposed within the hydraulic cylinder outside of the hollow ram;

a second retraction chamber disposed between the hollow ram and the outer barrel;

a second expansion chamber disposed within a second end of the hollow ram; and a concentric tube that passes through the piston into the hollow ram, wherein the concentric tube comprises: (i) an inner tube secured to a fluid inlet gland and a retraction port of an inner gland within the hollow ram, wherein the inner tube is configured to transfer hydraulic fluid between the fluid inlet gland to the inner gland; and (ii) an outer tube fluidly connecting the first expansion chamber to the second expansion chamber, wherein the outer tube is configured to transfer the hydraulic fluid between the first and second expansion chambers.

20. A hydraulic cylinder comprising:

an outer barrel;

a hollow ram secured to a piston, wherein the hollow ram is moveably secured within the outer barrel;

a concentric tube that passes through the piston into the hollow ram;

an inner gland secured to a portion of the concentric tube, wherein the inner gland includes a retraction portion and an expansion port;

a first retraction chamber disposed between the inner gland and the piston;

a first expansion chamber disposed within the hydraulic cylinder outside of the hollow ram;

a second retraction chamber disposed between the hollow ram and the outer barrel; and a second expansion chamber disposed between the inner gland and an end face of the hollow ram, wherein the retraction port is fluidly connected to one or both of the first and second retraction chambers, and wherein the expansion port that is fluidly connected to one or both of the first and second expansion chambers.

* * * * *